US010424875B2

(12) United States Patent
Chiang et al.

(10) Patent No.: US 10,424,875 B2
(45) Date of Patent: Sep. 24, 2019

(54) ELECTRICAL CONNECTOR

(71) Applicant: Molex, LLC, Lisle, IL (US)

(72) Inventors: Yueh-Ting Chiang, Taipei (TW); Ting-Chang Tseng, Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/415,131

(22) Filed: Jan. 25, 2017

(65) Prior Publication Data

US 2017/0302030 A1 Oct. 19, 2017

(30) Foreign Application Priority Data

Jan. 28, 2016 (CN) ..... 2016 1 0059038

(51) Int. Cl.

| | |
|---|---|
| ***H01R 4/02*** | (2006.01) |
| ***H01R 13/41*** | (2006.01) |
| ***H01R 24/62*** | (2011.01) |
| ***H01R 107/00*** | (2006.01) |
| ***H01R 13/405*** | (2006.01) |
| ***H01R 13/6471*** | (2011.01) |
| ***H01R 13/6474*** | (2011.01) |

(52) U.S. Cl.

CPC ..... *H01R 13/6474* (2013.01); *H01R 4/023* (2013.01); *H01R 13/405* (2013.01); *H01R 13/41* (2013.01); *H01R 13/6471* (2013.01); *H01R 24/62* (2013.01); *H01R 2107/00* (2013.01)

(58) Field of Classification Search

CPC ..... H01R 4/023; H01R 4/024; H01R 4/02; H01R 12/79; H01R 12/592; H01R 23/662; H01R 4/185; H01R 4/184; H01R 13/6474; H01R 13/6471; H01R 13/405; H01R 13/41; H01R 24/62; H01R 2107/00

USPC ..... 439/874–876, 497, 492, 578, 579, 877

See application file for complete search history.

(56) References Cited

U.S. PATENT DOCUMENTS

| | | | | |
|---|---|---|---|---|
| 5,293,177 A * | 3/1994 | Sakurai | H01Q 1/1271 | 343/906 |
| 5,451,174 A * | 9/1995 | Bogursky | H01R 12/57 | 439/83 |
| 5,762,526 A * | 6/1998 | Kuramoto | F04C 23/008 | 439/874 |
| 5,879,206 A * | 3/1999 | Badgley | B23K 1/00 | 228/114.5 |

(Continued)

FOREIGN PATENT DOCUMENTS

| | | |
|---|---|---|
| CN | 2454921 Y | 10/2001 |
| CN | 2458760 Y | 11/2001 |

(Continued)

*Primary Examiner* — Gary F Paumen
(74) *Attorney, Agent, or Firm* — Molex, LLC

(57) ABSTRACT

An electrical connector comprises an insulative housing, a plurality of terminals and a plurality of wires. The plurality of terminals are fixed to the insulative housing, each terminal has a fixed portion fixed to the insulative housing and a contact portion and a soldering portion which are respectively connected to the fixed portion, the soldering portion of each terminal of at least a part of the plurality of terminals is formed with a bending section, and an inner surface of the bending section defines a filling space for filling a solder. A plurality of wires are respectively soldered to the soldering portions of the plurality of terminals and make the solder filled in each filling space.

12 Claims, 10 Drawing Sheets

(56) References Cited

U.S. PATENT DOCUMENTS

| | | | | |
|---|---|---|---|---|
| 5,967,833 | A * | 10/1999 | Cachina | H01R 23/661 439/499 |
| 6,039,616 | A * | 3/2000 | Pereira | H01R 4/02 439/83 |
| 6,773,293 | B1 | 8/2004 | Lee | |
| 7,435,132 | B1 * | 10/2008 | Fong | H01R 9/038 439/497 |
| 7,534,143 | B1 * | 5/2009 | Tsao | H01R 13/58 439/497 |
| 9,130,312 | B2 | 9/2015 | Wu et al. | |
| 2004/0058587 | A1 * | 3/2004 | Huang | H01R 11/16 439/877 |
| 2008/0009204 | A1 * | 1/2008 | Wei | H01R 4/723 439/877 |
| 2010/0105256 | A1 * | 4/2010 | Lyford | H01R 4/20 439/877 |
| 2016/0254620 | A1 * | 9/2016 | O'Young | H01R 13/7039 439/76.1 |

FOREIGN PATENT DOCUMENTS

| | | | |
|---|---|---|---|
| CN | 2552173 | Y | 5/2003 |
| CN | 2660712 | Y | 12/2004 |
| CN | 2814703 | Y | 9/2006 |
| CN | 200990433 | Y | 12/2007 |
| CN | 201207469 | Y | 3/2009 |
| CN | 202906120 | U | 4/2013 |
| TW | M468064 | U | 12/2013 |

* cited by examiner

FIG. 1
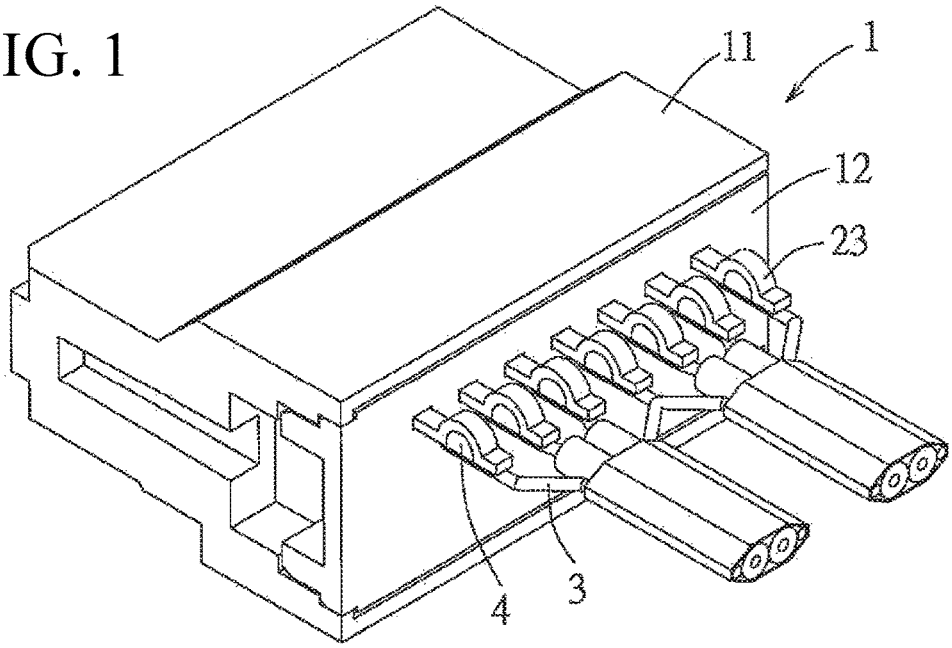
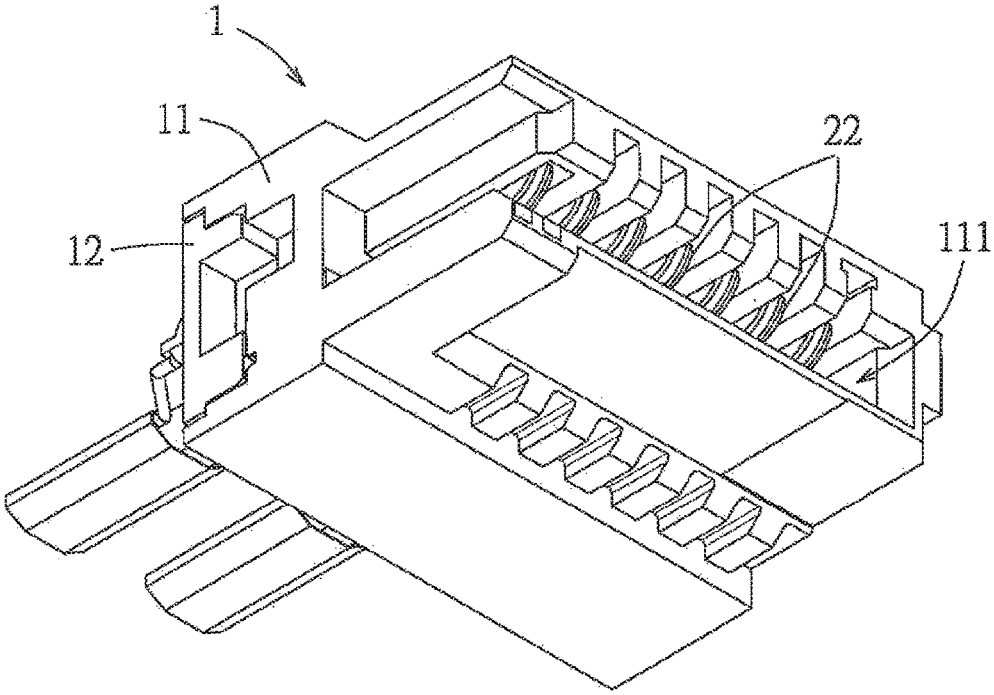
FIG. 2

ELECTRICAL CONNECTOR

RELATED APPLICATIONS

This application claims priority to Chinese Application No. 201610059038.5, filed Jan. 28, 2016, which is incorporated herein by reference in its entirety.

TECHNICAL FIELD

The present disclosure relates to an electrical connector, and more specifically relates to an electrical connector with soldering wires.

BACKGROUND ART

Generally, an electrical connector with soldering wires, for example, as disclosed in Taiwan patent TW575256U, because a location where a wire and a terminal of the electrical connector are soldered is exposed to air, and a dielectric coefficient of air is less than a dielectric coefficient of an insulating body, therefore a higher impedance is produced at the joint and affects the performance of the signal transmission.

SUMMARY OF THE INVENTION

Therefore, an object of the present disclosure is to provide an electrical connector which can reduce an impedance of a location where a wire and a terminal are soldered.

Accordingly, in some embodiments, an electrical connector of the present disclosure comprises an insulative housing, a plurality of terminals and a plurality of wires. The plurality of terminals are fixed to the insulative housing, each terminal has a fixed portion fixed to the insulative housing and a contact portion and a soldering portion which are connected to the fixed portion, the soldering portion of each terminal of at least a part of the plurality of terminals is formed with a bending section, and an inner surface of the bending section defines a filling space for filling a solder. The plurality of wires are respectively soldered to the soldering portions of the plurality of terminals and make the solder filled in each filling space.

In some embodiments, the soldering portion of each terminal is plate-like. In some embodiments, each filling space is fully filled with the solder. In some embodiments, each wire is soldered to the first surface of the corresponding soldering portion.

In some embodiments, the soldering portion of each terminal has a first surface and a second surface which are respectively positioned at opposite sides and two side surfaces, one side surface connects one side of the first surface and one side of the second surface, the other side surface connects the other side of the first surface and the other side of the second surface, and the first surface is the inner surface of the bending section.

In some embodiments, each wire is soldered to the first surface of the corresponding soldering portion, and the wire soldered to the soldering portion formed with the bending section extends across the filling space of the corresponding bending section. In some embodiments, the plurality of terminals are arranged so that the side surfaces of the soldering portions of the plurality of terminals face each other and are spaced apart from each other.

In some embodiments, the plurality of terminals are arranged so that the side surfaces of the soldering portions of one part of the plurality of terminals face each other and are spaced apart from each other in a first row, and the side surfaces of the soldering portions of the other part of the plurality of terminals face each other and are spaced apart from each other in a second row, the second row is parallel to the first row.

In some embodiments, the soldering portion of each terminal is formed with the bending section. In some embodiments, the two soldering portions of the two adjacent terminals each are formed with the bending section, and the two bending sections of the two adjacent terminals each are formed with a protruding block so that the two adjacent protruding blocks protrude relative to each other.

In some embodiments, each terminal of one part of the plurality of terminals is a signal terminal, each terminal of the other part of the plurality of terminals is a ground terminal, the soldering portion of each signal terminal is formed with the bending section. In some embodiments, the plurality of terminals are a pair of signal terminals and two ground terminals respectively positioned at both sides of the pair of signal terminals.

In some embodiments, the plurality of terminals are two pairs of signal terminals and three ground terminals respectively positioned between the two pairs of signal terminals and both sides of the two pairs of signal terminals. In some embodiments, the plurality of terminals are defined as an arrangement of alternate signal terminal and ground terminal.

BRIEF DESCRIPTION OF THE DRAWINGS

Other characteristics and effects of the present disclosure will be apparent through detailed description of embodiments with referring to the Figures, and in which:

FIG. 1 is a perspective view of a first embodiment of an electrical connector of the present disclosure;

FIG. 2 is another perspective view of the embodiment depicted in FIG. 1;

DETAILED DESCRIPTION OF THE PREFERRED EMBODIMENTS

Figure 3:
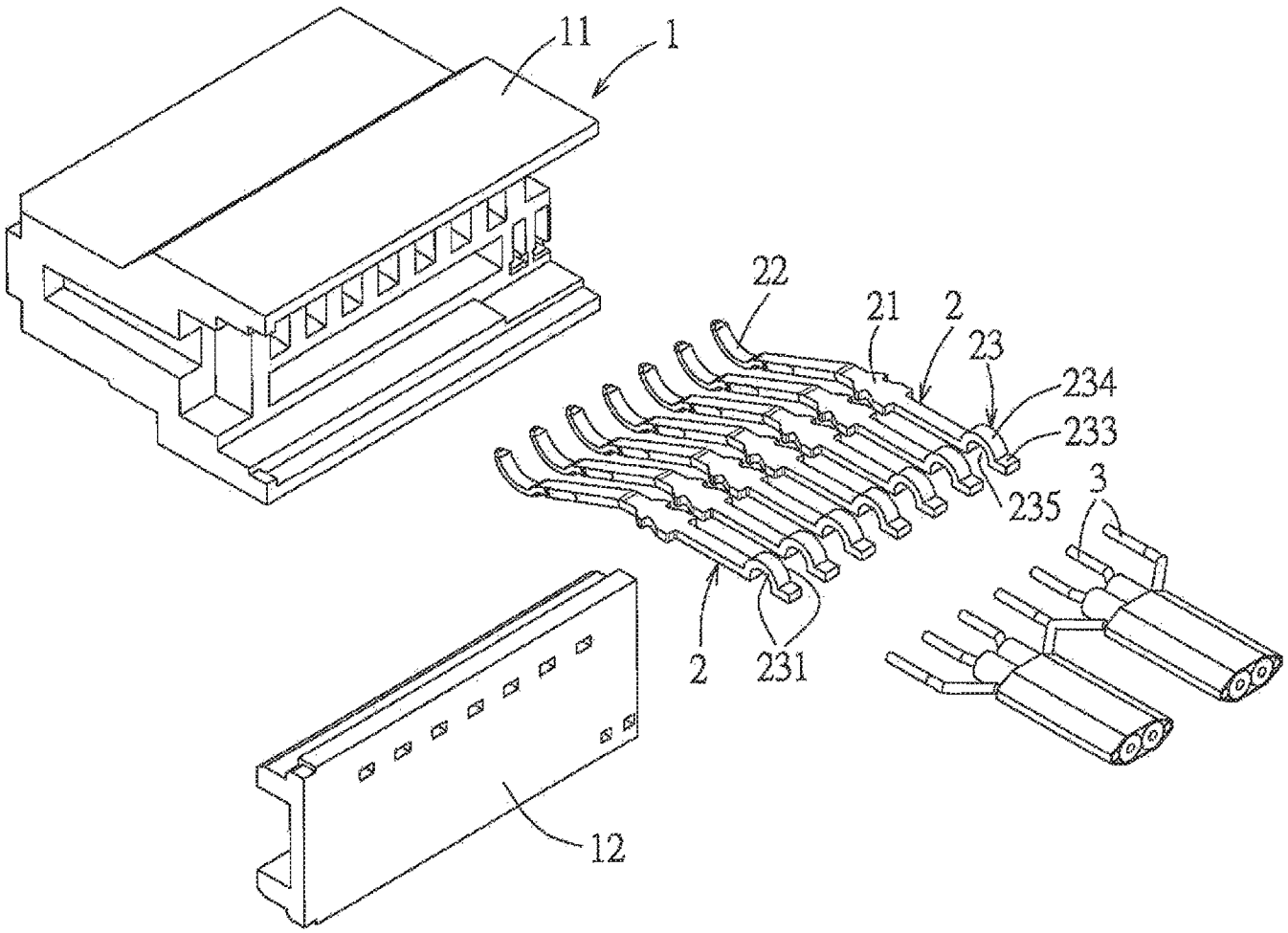
FIG. 3 is an exploded perspective view of the embodiment depicted in FIG. 1.
Figure 4:
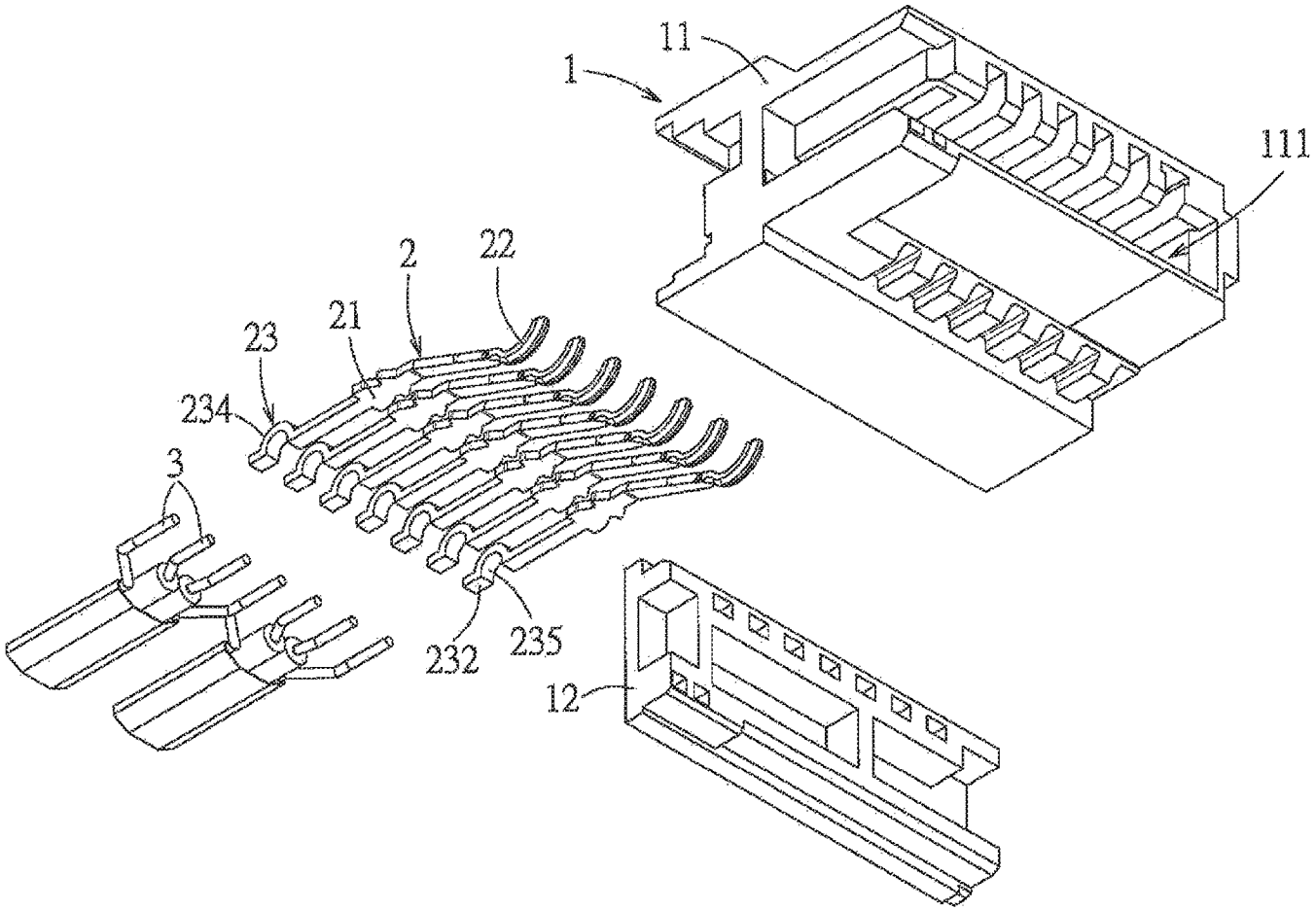
FIG. 4 is another perspective view of the embodiment depicted in FIG. 3.

Before the present disclosure is described in detail, it should be noted that similar element is indicated by the same reference numeral in the following description. As can be appreciated, the present disclosure has the following effect: the conducting area on each of both side surfaces of the soldering portion can be increased via the soldering area formed by the solder being filled in the filling space of the soldering portion, thereby increasing the capacitance effect and in turn reducing the impedance. In addition, the wire and the terminal can have improved soldering strength.

Referring to FIG. 1 through FIG. 4, a first embodiment of an electrical connector in the present disclosure comprises an insulative housing 1, a plurality of terminals 2 and a plurality of wires 3. In the embodiment, the insulative housing 1 comprises a body 11 and a rear cover 12 combined with the body 11, however the insulative housing 1 also may only comprise the body 11, that is the rear cover 12 is omitted. The body 11 has a slot 111.

Figure 7:
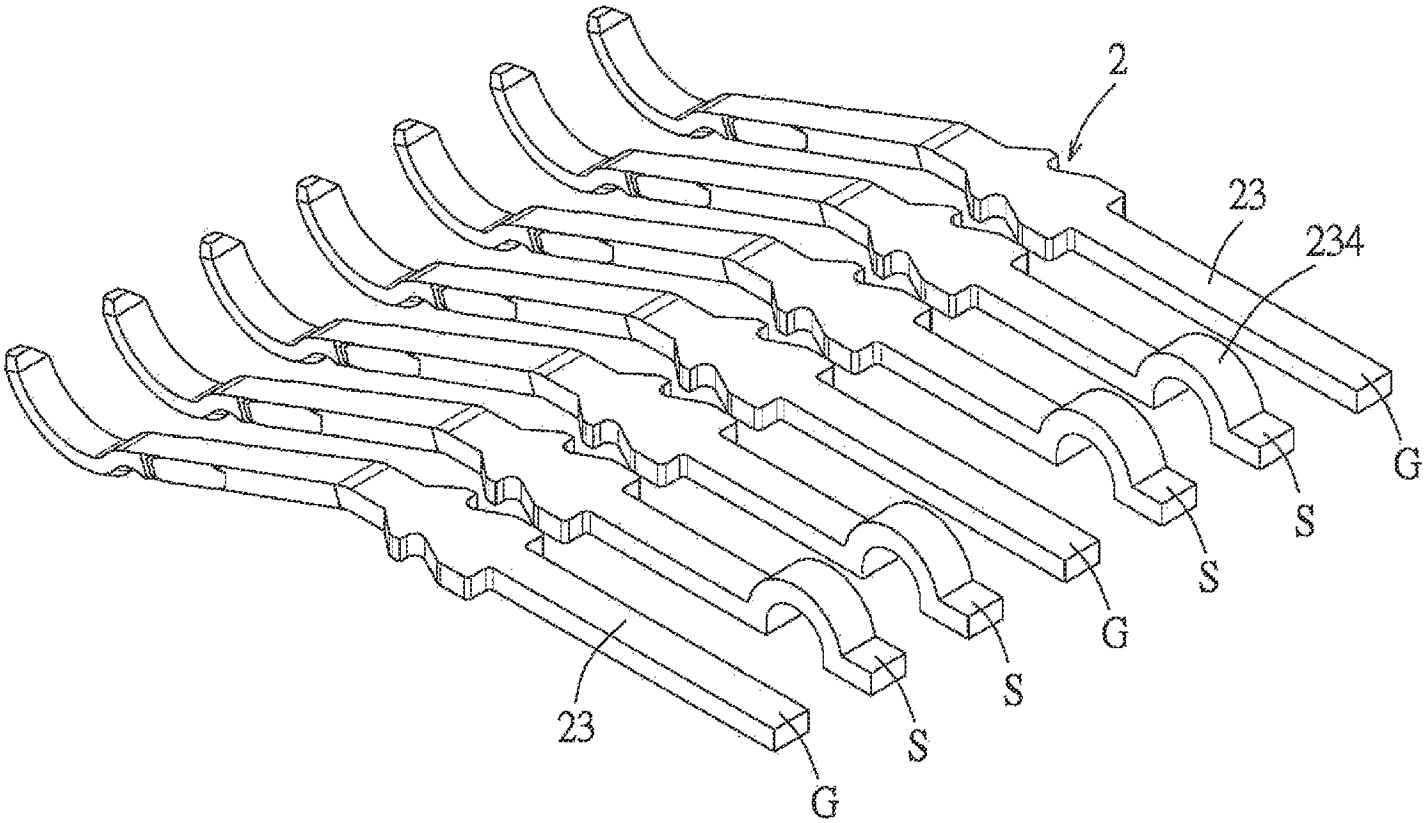
FIG. 7 is a perspective view of another embodiment of terminals and a footprint definition of the plurality of terminals.
Figure 8:
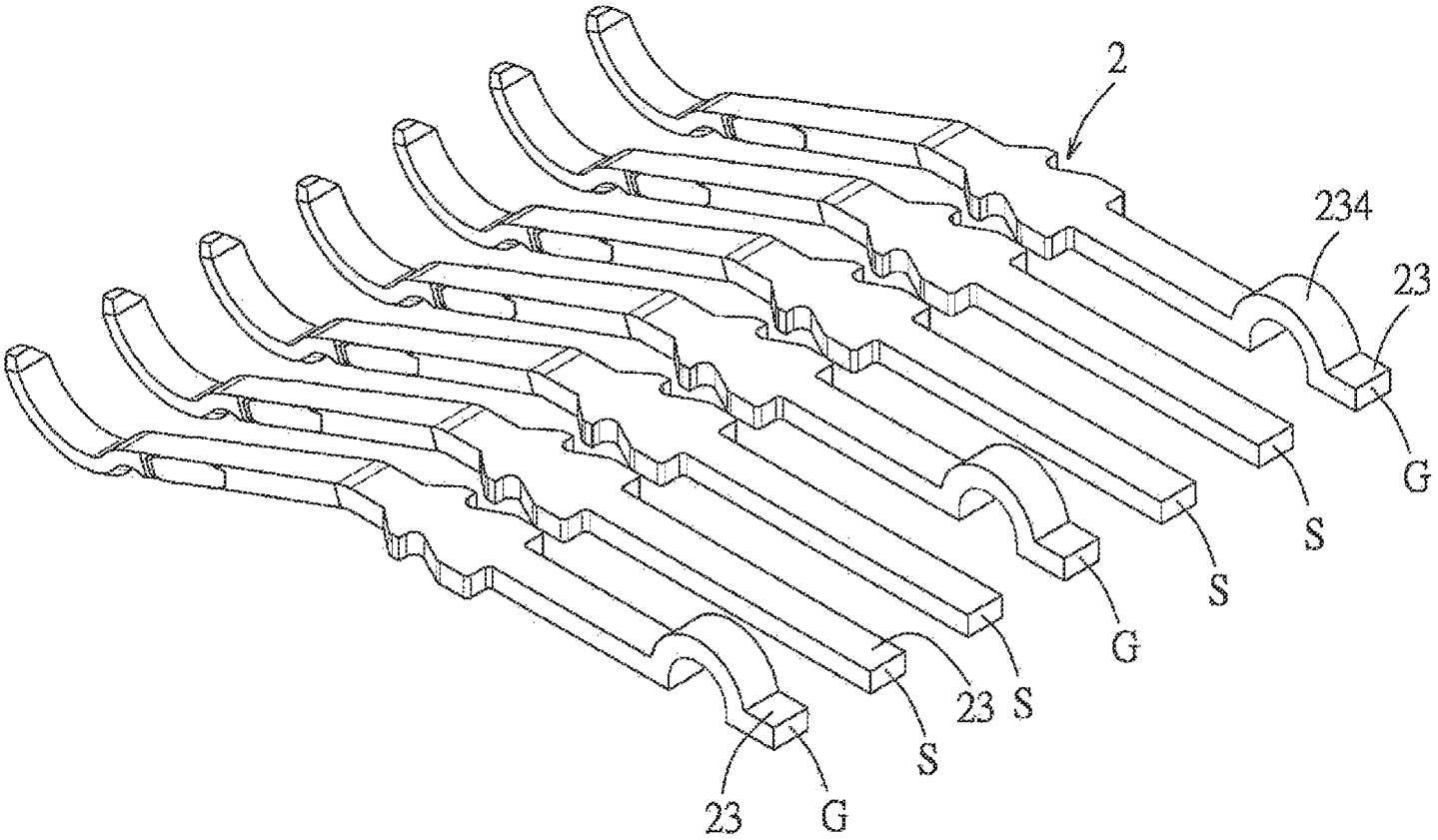
FIG. 8 is a perspective view of another embodiment of terminals and a footprint definition of the plurality of terminals.

The plurality of terminals 2 are fixed to the insulative housing 1 side by side. Each terminal 2 has a fixed portion 21 fixed to the insulative housing 1 and a contact portion 22 and a soldering portion 23 which are connected to the fixed portion 21. The contact portion 22 extends into the slot 111. The soldering portion 23 extends out of the rear cover 12, and comprises a first surface 232 and a second surface 233 which are respectively positioned at opposite sides and two side surfaces 231, one side surface 231 connects one side of the first surface 232 and one side of the second surface 233 and the other side surface 231 connects the other side of the first surface 232 and the other side of the second surface 233. The soldering portion 23 of each terminal 2 of at least a part of the plurality of terminals 2 is formed with a bending section 234, and an inner surface of the bending section 234 defines a filling space 235 for filling a solder 4. In the embodiment, the soldering portion 23 is plate-like which is easier to bend to form the bending section 234 and thus has the larger inner surface to carry a solder 4, and the first surface 232 is the inner surface of the bending section 234. In the embodiment, the soldering portion 23 of each terminal 2 of the plurality of terminals 2 is formed with the bending section 234, however in other embodiments, only the soldering portion 23 of each terminal 2 of a part of the plurality of terminals 2 may be formed with the bending section 234 (as shown in FIG. 7 and FIG. 8).

Figure 5:
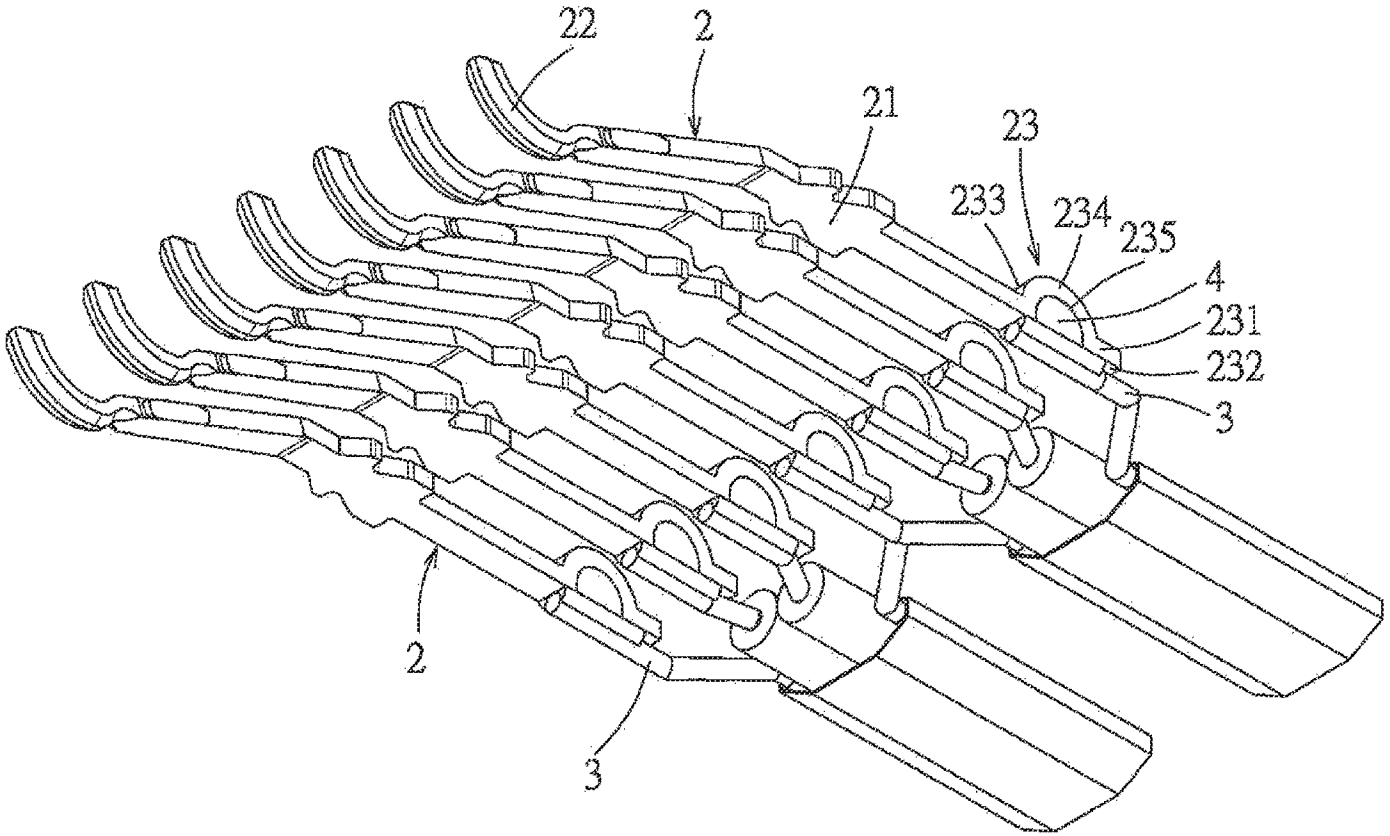
FIG. 5 is a perspective view of an embodiment illustrating a soldering relationship between a plurality of terminals and corresponding wires.

Also referring to FIG. 5, the plurality of wires 3 are respectively soldered to the soldering portions 23 of the plurality of terminals 2, and the solder 4 is filled in each filling space 235. In the embodiment, each filling space 235 is fully filled with the solder 4, each wire 3 is soldered to the first surface 232 of the corresponding soldering portion 23, and extends across the filling space 235 of the corresponding bending section 234. A conducting area on each of both side surfaces 231 of the soldering portion 23 can be increased via a soldering area formed by the solder 4 being filled in the filling space 235 of the soldering portion 23, thereby increasing the capacitance effect and in turn reducing the impedance, and the wire 3 and the terminal 2 have a better soldering strength. Even if each filling space 235 is not fully filled with the solder 4, an effect of reducing the impedance is also attained, however, it is better for the filling space 235 to be fully filled with the solder 4. A size of the filling space 235 can be adjusted by a length and a bending depth of the bending section 234, a matching impedance can be controlled by adjusting the filling space 235.

Figure 6:
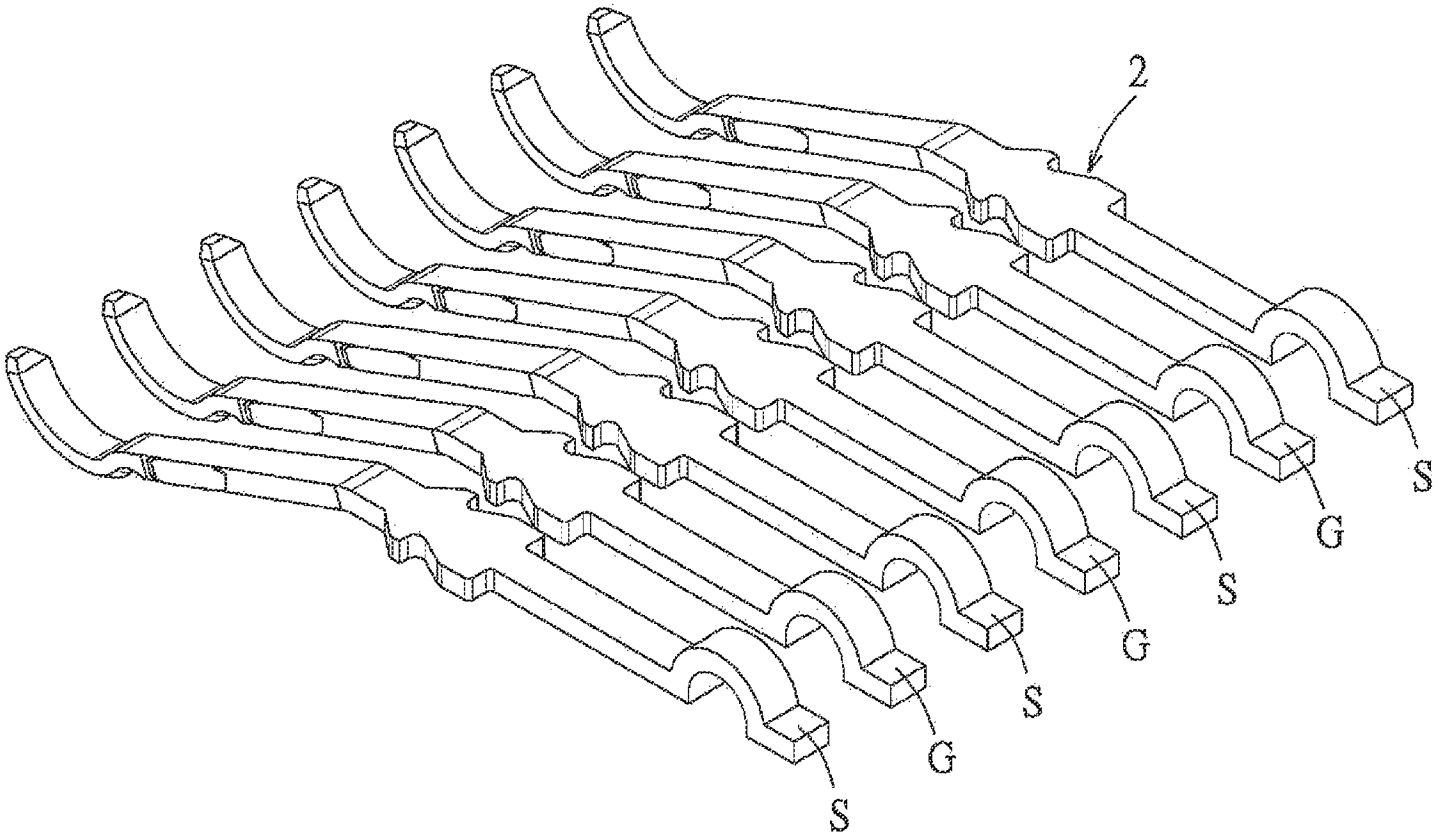
FIG. 6 is a perspective simplified view of the embodiment depicted in FIG. 5, illustrating a footprint definition of the plurality of terminals.

The plurality of terminals 2 can define a footprint according to transmission specifications of the electrical connector. For example, referring to FIG. 6, the plurality of terminals 2 can be defined as an arrangement of alternate signal terminal S and ground terminal G; for example, referring to FIG. 7 and FIG. 8, the plurality of terminals 2 can be defined as two pairs of signal terminals S and three ground terminals G respectively positioned between the two pairs of signal terminals S and both sides of the two pairs of signal terminals S, as shown in FIG. 7, the soldering portion 23 of each signal terminal S is formed with the bending section 234, as shown in FIG. 8, the soldering portion 23 of each ground terminal G is formed with the bending section 234. In other embodiment, that the soldering portion 23 of each terminal 2 of a part of the plurality of terminals 2 is formed with the bending sections 234 also can be configured so that the soldering portion 23 of one of every two adjacent terminals 2 is formed with the bending sections 234, but it is not limited to that the bending sections 234 are only formed to the ground terminals G or the bending sections 234 are only formed to the signal terminals S. Certainly, the number of terminals 2 can adjusted depending on the transmission specifications of the electrical connector. In the embodiment, the number of terminals 2 is seven, however also can be adjusted as for example four, and the terminals 2 can be defined as a pair of signal terminals S and two ground terminals G respectively positioned at both sides of the pair of signal terminals S, therefore, a varied implementation of the terminals 2 is not limited to the embodiment.

Figure 9:
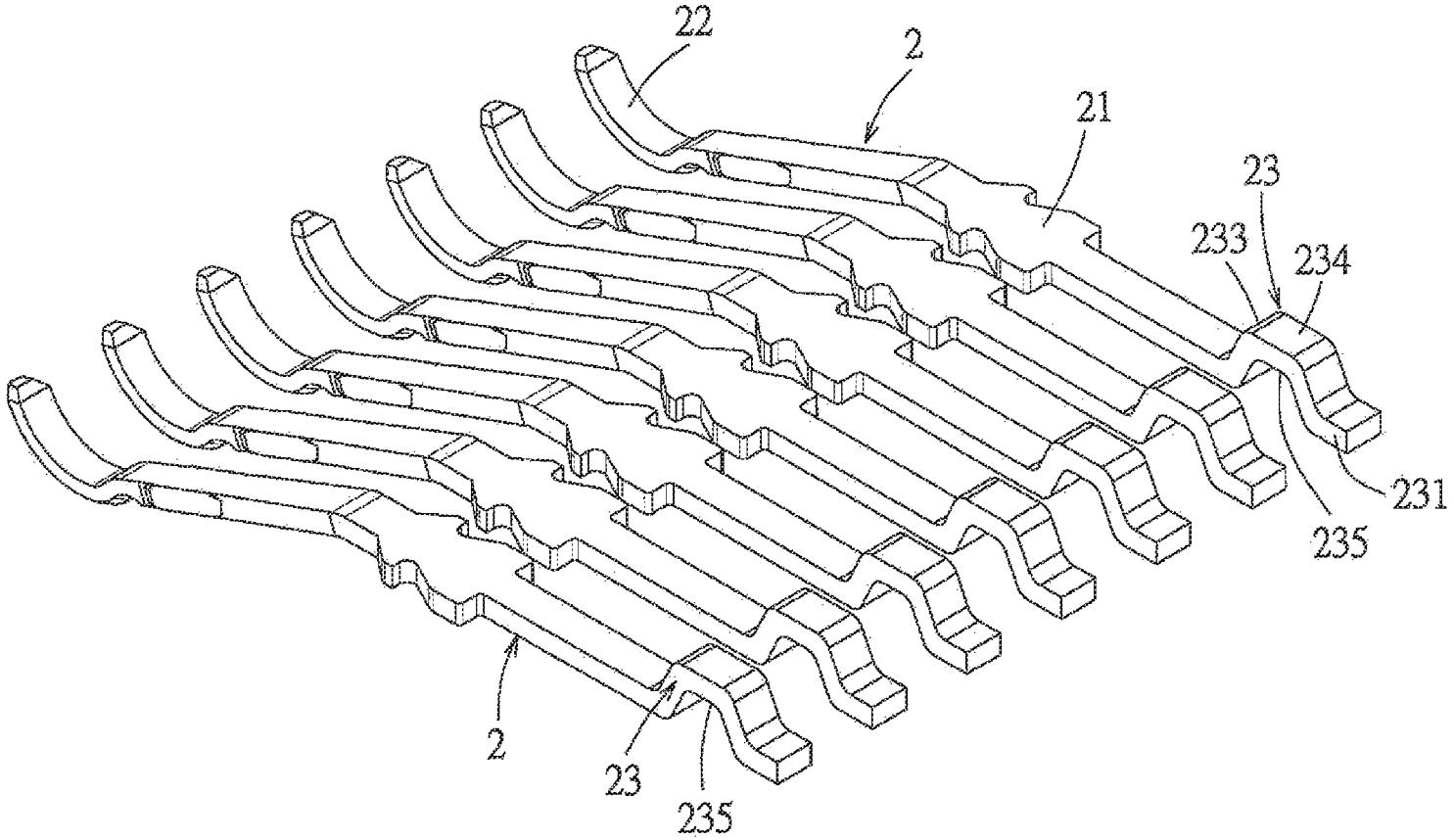
FIG. 9 is a perspective view of another embodiment of terminals suitable for use in an electrical connector.

Referring to FIG. 9, a second embodiment of the electrical connector in the present disclosure is substantially the same as the first embodiment, however, in the first embodiment, the bending section 234 of the soldering portion 23 of the terminal 2 is arc, and in the second embodiment, the bending section 234 of the soldering portion 23 of the terminal 2 is approximately trapezoid and defines the filling space 235 which is trapezoid.

Figure 10:
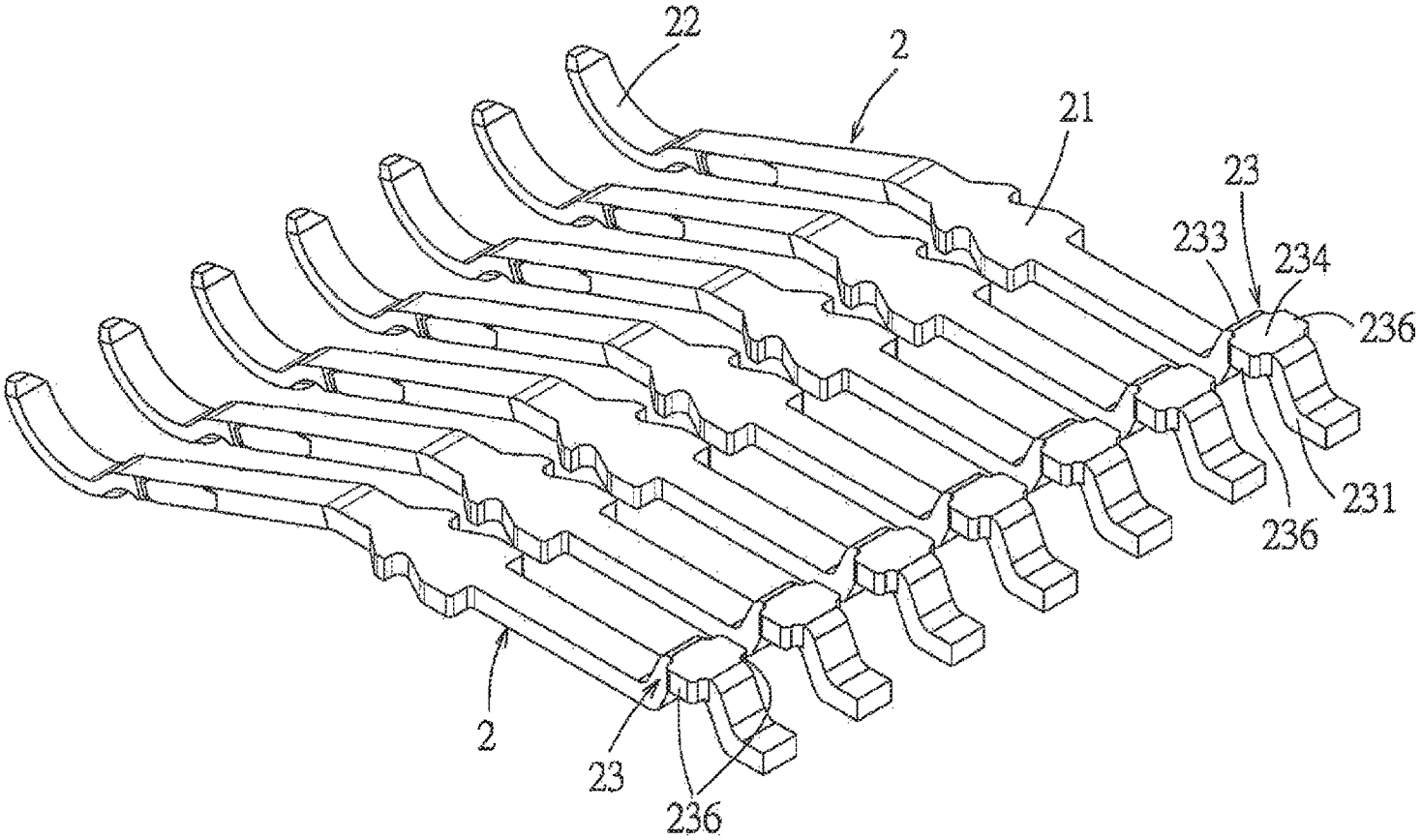
FIG. 10 is a perspective view of another embodiment of terminals suitable for use in an electrical connector.

Referring to FIG. 10, a third embodiment of the electrical connector in the present disclosure is substantially the same as the second embodiment, however, in the third embodiment, the two bending sections 234 of the two adjacent terminals 2 each are formed with a protruding block 236 so that the two adjacent protruding blocks 236 protrude relative to each other, thereby increasing the capacitance effect and reducing the impedance.

Figure 11:
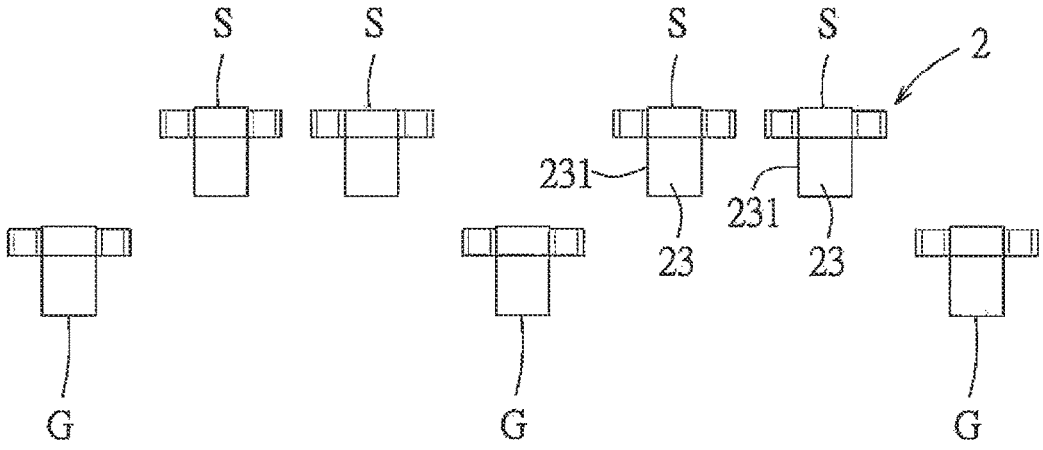
FIG. 11 is a rear elevated view illustrating an embodiment of terminals of an electrical connector that are arranged in an upper row and a lower row.
Figure 12:
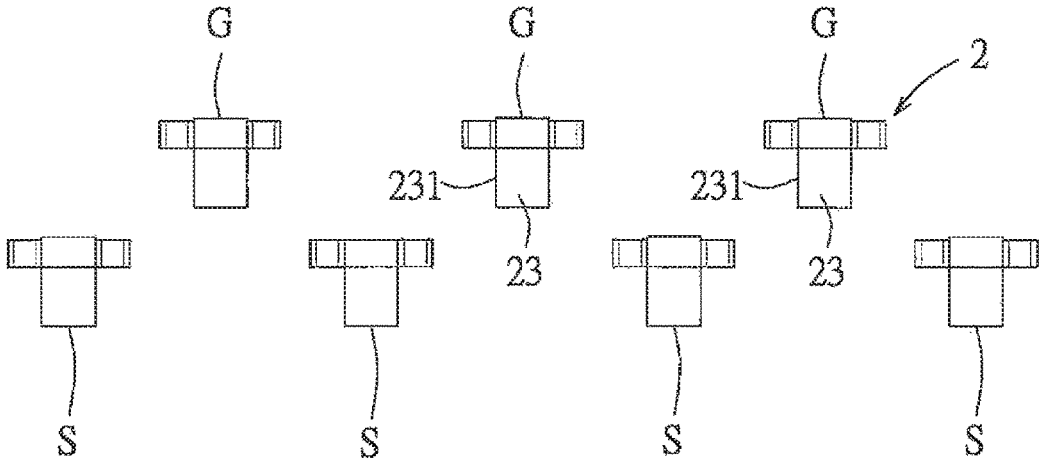
FIG. 12 is another rear elevated view illustrating another embodiment of terminals of an electrical connector that are arranged in an upper row and a lower row.

In the above embodiments, the plurality of terminals 2 are arranged so that the side surfaces 231 of the soldering portions 23 of the plurality of terminals 2 face each other and are spaced apart from each other, however in a modified implementation, the plurality of terminals 2 also may not be arranged side by side in the same plane, for example, referring to FIG. 11 and FIG. 12, the plurality of terminals 2 are arranged so that the side surfaces 231 of the soldering portions 23 of one part of the plurality of terminals 2 face each other and are spaced apart from each other in a first row and the side surfaces 231 of the soldering portions 23 of other part of the plurality of terminals 2 face each other and are spaced from each other in a second row, the second row is parallel to the first row. As shown in FIG. 11 and FIG. 12, the plurality of terminals 2 are arranged in two rows, the ground terminals G are in the first row or the second row, and the signal terminals S are in the second row or the first row.

In conclusion, the conducting area on each of both side surfaces 231 of the soldering portion 23 can be increased via the soldering area formed by the solder 4 being filled in the filling space 235 of the soldering portion 23, thereby increasing the capacitance effect and in turn reducing the impedance, and the wire 3 and the terminal 2 have a better soldering strength.

The above described contents are only the embodiments of the present disclosure, which cannot limit the scope of the implementation of the present disclosure, namely simple equivalent variations and modifications made according to the claims and the content of the present disclosure are still fallen within the scope of the present disclosure.

What is claimed is:

1. An electrical connector, comprising:

an insulative housing;

a plurality of terminals fixed to the insulative housing, each terminal having a fixed portion fixed to the insulative housing and a contact portion and a soldering portion which are connected to the fixed portion, the soldering portion of each terminal of at least a part of the plurality of terminals being formed with a bending section, and an inner surface of the bending section defining a filling space for filling with solder; and a plurality of wires respectively soldered to the soldering portions of the plurality of terminals each in a lengthwise direction along a side of the respective filling space, making contact with the solder in that filling space, wherein the soldering portion of each terminal has a first surface and a second surface which are respectively positioned at opposite sides and two side surfaces, one side surface connects one side of the first surface and one side of the second surface, the other side surface connects the other side of the first surface and the other side of the second surface, and the first surface includes the inner surface of the bending section, wherein the plurality of terminals are arranged so that the side surfaces of the soldering portions of the plurality of terminals face each other and are spaced apart from each other.

2. The electrical connector according to claim 1, wherein the soldering portion of each terminal is plate-like.

3. The electrical connector according to claim 1, wherein each filling space is fully filled with solder.

4. The electrical connector according to claim 1, wherein each wire is soldered to the first surface of the corresponding soldering portion.

5. The electrical connector according to claim 1, wherein each wire is soldered to the first surface of the corresponding soldering portion, and the wire soldered to the soldering portion formed with the bending section extends across the filling space of the corresponding bending section.

6. The electrical connector according to claim 1, wherein the soldering portion of each terminal is formed with a bending section.

7. The electrical connector according to claim 1, wherein the two soldering portions of two adjacent terminals each are formed with a bending section, and the two bending sections of the two adjacent terminals each are formed with a protruding block so that the two adjacent protruding blocks protrude relative to each other.

8. The electrical connector according to claim 1, wherein each terminal of one part of the plurality of terminals is a signal terminal, each terminal of the other part of the plurality of terminals is a ground terminal, the soldering portion of each signal terminal is formed with the bending section.

9. The electrical connector according to claim 8, wherein the plurality of terminals are a pair of signal terminals and two ground terminals respectively positioned at both sides of the pair of signal terminals.

10. The electrical connector according to claim 8, wherein the plurality of terminals are two pairs of signal terminals and three ground terminals respectively positioned between the two pairs of signal terminals and both sides of the two pairs of signal terminals.

11. The electrical connector according to claim 8, wherein the plurality of terminals are defined as an arrangement of alternate signal and ground terminals.

12. An electrical connector, comprising:

an insulative housing;

a plurality of terminals fixed to the insulative housing, each terminal having a fixed portion fixed to the insulative housing and a contact portion and a soldering portion which are connected to the fixed portion, the soldering portion of each terminal of at least a part of the plurality of terminals being formed with a bending section, and an inner surface of the bending section defining a filling space for filling with solder; and a plurality of wires respectively soldered to the soldering portions of the plurality of terminals each in a lengthwise direction along a side of the respective filling space, making contact with the solder in that filling space, wherein the soldering portion of each terminal has a first surface and a second surface which are respectively positioned at opposite sides and two side surfaces, one side surface connects one side of the first surface and one side of the second surface, the other side surface connects the other side of the first surface and the other side of the second surface, and the first surface includes the inner surface of the bending section, wherein the plurality of terminals are arranged so that the side surfaces of the soldering portions of one part of the plurality of terminals face each other and are spaced apart from each other in a first row, and the side surfaces of the soldering portions of the other part of the plurality of terminals face each other and are spaced apart from each other in a second row, the second row is parallel to the first row.

* * * * *